United States Patent [19]

Gross et al.

[11] 4,341,977

[45] Jul. 27, 1982

[54] ARC SPREADING WITH INITIATORS

[76] Inventors: Leo Gross, 3611 217 St., Bayside, N.Y. 11361; S. Merrill Skeist, 1620 Cedar Swamp Rd., Brookville, Glen Head, N.Y. 11545

[21] Appl. No.: 117,949

[22] Filed: Feb. 4, 1980

[51] Int. Cl.[3] ..... H01J 61/12

[52] U.S. Cl. ..... 313/485; 313/223

[58] Field of Search ..... 313/484, 485, 223–226

[56] References Cited

U.S. PATENT DOCUMENTS 2,419,902 4/1947 Mager ..... 313/225 X

*Primary Examiner*—Eugene La Roche

[57] ABSTRACT

An arc discharge device such as a fluorescent lamp comprising an envelope having an inner phosphor coating. Arc discharge filaments are disposed in said envelope together with a rare gas such as argon and an arc spreading initiator gas such as a combination of nitrogen and dichloro-difluoro ethane.

6 Claims, 3 Drawing Figures

ARC SPREADING WITH INITIATORS

BACKGROUND OF THE INVENTION

1. Field of the Invention

The present invention relates to a fluorescent lamp with greater efficacy then previously available. The lamp has a non-circular cross-section through which the arc is spread by the inclusion of arc spreading initiators in the low pressure gas within the lamp. These arc spreading initiators cause the arc current to flow closer to the phosphored surface, thereby increasing light output.

2. Description of the Prior Art

The technique of magnetic arc spreading to increase efficacy and light output was described in co-pending applications Ser. Nos. 834,651 and 045,589, wherein magnetic fields spread the arc to occupy the full volume of the lamp. A similar effect, electric field arc spreading was utilized in a high intensity arc discharge lamp, co-pending application Ser. No. 117,950. These method of arc spreading utilize external forces created by magnetic or electric fields. The present invention accomplishes the same results with forces generated by the arc discharge through the rarified gas with arc spreading initiators, gaseous compounds, at low concentration within the lamp envelope.

When the arc current in a fluorescent arc discharge lamp lies closer to the phosphored wall, lamp efficacy is increased. One way of achieving this effect is with grooves or depressions placed in the long, essentially cylindrical envelope. Shurgan et al in U.S. Pat. No. 3,988,633 state that grooves alter the wall recombination rate of the plasma ions and increase the plasma arc stream length, thereby increasing luminous output.

When the arc is forced to move in response to an external force, the arc can be spread to fill the entire volume of a lamp envelope of any shape.

Gross and Skeist utilize magnetic arc spreading in co-pending applications Ser. Nos. 834,651 and 045,589 to spread the arc discharge throughout the lamp with a highly flattened elliptical or oval cross-section. Electrostatic forces can be applied to accomplish the same effect (U.S. patent application, Ser. No. 117,950). Campbell in U.S. Pat. No. 3,609,436 moves the discharge throughout an envelope by sequentially switching the arc to a multiplicity of electrodes.

Some fluorescent lamps are inherently unstable and the arc twists, swirls, or spirals within the long cylindrical envelope. The "Approved Method for the Electrical and Photometric Measurements of Fluorescent Lamps" (IES publication LM-9, par. 7-d, Sept. 1967) notes that "Swirling can usually be detected with the naked eye. However, there are also invisible or incipient swirls . . . These can usually be discovered by running a small permanent magnet along the length of the lamp. Any incipient swirling will evidence itself by a perceptible brightening at the spot where swirling exists." No application of this phenomenon to light production has been noted prior to this invention. Thus, an object of this invention is the provision of fluorescent lamps of greater efficacy and luminous output applying the phenomenon of arc spreading by initiators within gaseous contents of the lamp.

A further object of this invention is the availability of a multitude of lamp shapes possible since arc spreading frees the designer from the constraint of long, straight lamps of circular cross-section, 1.5" or less in diameter.

Yet another object of this invention is to provide a fluorescent lamp compatible with the Edison socket in order to realize the energy savings inherent in the greater efficacy of fluorescent lamps compared to the 17 lumens/watt output of a 100 watt incandescent lamp.

SUMMARY OF THE INVENTION

The present invention comprises a fluorescent lamp wherein low concentration constituents of the gas through which the arc discharge flows, create conditions causing the arc to shift to alternative paths. This arc movement occurs at a rapid rate and is seen as arc spreading. In the process the arc moves throughout the volume of the lamp, the arc current flowing close to the phosphored surface, thereby increasing light output and lamp efficacy.

DETAILED DESCRIPTION OF THE INVENTION

Figure 1:
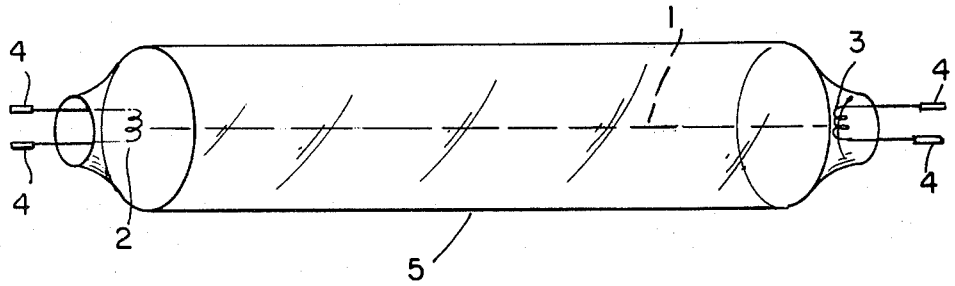
FIG. 1 is a side elevational view of a configuration of the arc spreading lamp in an extended form.

With continuing reference to the accompanying drawing, wherein like numerals designate similar parts throughout the various views, as shown in FIG. 1, a stable stationary arc would follow the shortest path through the lamp as indicated by the dotted line 1, and illuminate a limited region of the phosphor. According to the present invention, the addition of specific gaseous molecules, which we call arc spreading initiators, causes the arc to fill the lamp volume as described in the preceding paragraph. The partial pressure of the selected initiating agents controls the swirling (or twisting, spiralling, etc.) to fill the entire volume of the lamp envelope and to occur at such a rapid rate that flicker is unnoticed to the observing eye. Under this condition of operation, the arc oscillates, swirls, or moves in a manner undetectable to the naked eye. Thus we can define the arc as being spread throughout the lamp.

The amount of arc spreading initiators included is adjusted to lie within an appropriate range of concentrations. When the concentration is too low, the arc will change its location slowly and after a time reach stability when the small amount of the initiator is absorbed to the lamp wall. As the concentration of initiators is increased, the arc begins to spread at a rate which increases with increasing initiator concentration. In a range of concentrations above this level, the arc spreading frequency reaches a broad maximum where this dynamic situation remains relatively constant. At higher concentrations, the arc assumes twisted and stationary positions with frequent extinguishment until a concentration is reached at which the arc fails to strike. The appropriate concentration range for most efficient arc spreading is determined experimentally for each species of initiator.

The arc is established, see FIG. 1, controlling current flow in the customary manner with an external ballast between the filaments 2, 3 with power and starting potential supplied through pins 4. The lamp envelope 5 prior to sealing is filled with the usual rare gas, argon, at a pressure of 1 to 3 torr plus sufficient mercury to establish a vapor pressure of 10 microtorr. In order to achieve the object of this invention, arc spreading initiators are added in small amounts, the quantity dependent on the nature of each initiator. The object of this invention is to provide a novel fluorescent lamp by virtue of the minute quantities of initiators in the filling gas which will cause the arc to spread throughout the volume of the lamp envelope.

An initiator acts to spread the arc by creating localized disruption or increased voltage gradients in the positive column. The arc shifts to another region wherein the process is repeated. In this way, the arc is caused to traverse all regions of the lamp. The characteristics of the arc spreading initiators are the ability to form negative ions, to be stable under reconstitution, and to be unreactive with the molecules within the lamp—those of the gases, the phosphor, and the glass.

Compounds satisfying these requirements are gaseous compounds which can form negative ions and are stable under electron collisions, among which are nitrogen, low molecular weight-fluorinated alkanes (Freons). Based upon the molecular species used, the pressure may vary from 0.01 to more than 25 microtorr. As the pressure is raised, the swirling frequency increases. The arc is believed to shift to a new region and not return to its previous path until the initiators return to the un-ionized state. Thus, initiators with a long recovery time generate wide excursions. By a combination of two or more initiators at judiciously chosen pressures, the arc can be controlled as to excursion and frequency and thus the filling gases can be selected to cause the arc to fill the entire volume of the envelope at a rate of motion so rapid as to be undetectable to the eye. A combination of nitrogen at 0.1 to 0.2 microtorr and dichloro-difluoro-ethane at 0.25 microtorr is one mixture, among others, that will accomplish this arc spreading effect.

Figure 2:
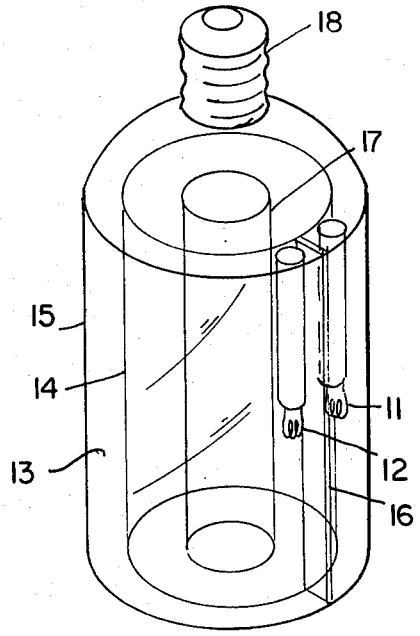
FIG. 2 is a perspective view illustrating an embodiment of an arc spreading fluorescent lamp adaptable to an Edison socket; and, FIG. 3 is a perspective view of another embodiment of a fluorescent lamp with arc spreading.

FIG. 2 shows one of many versions possible for a compact lamp. The lamp includes a screw plug to fit conventional Edison sockets. This lamp shape is feasible due to trace concentrations of arc spreading initiators as previously described. The arc discharge flows between filaments 11, 12 and fills the entire volume of the lamp 13. The lamp consists of an inner section 14, which mates with the outer envelope 15 and is sealed along the partition 16 to constrain the arc to follow a path around the lamp. The ballast 17 can be housed in the hollow center of the lamp, which is fitted with a screw plug 18.

Figure 3:
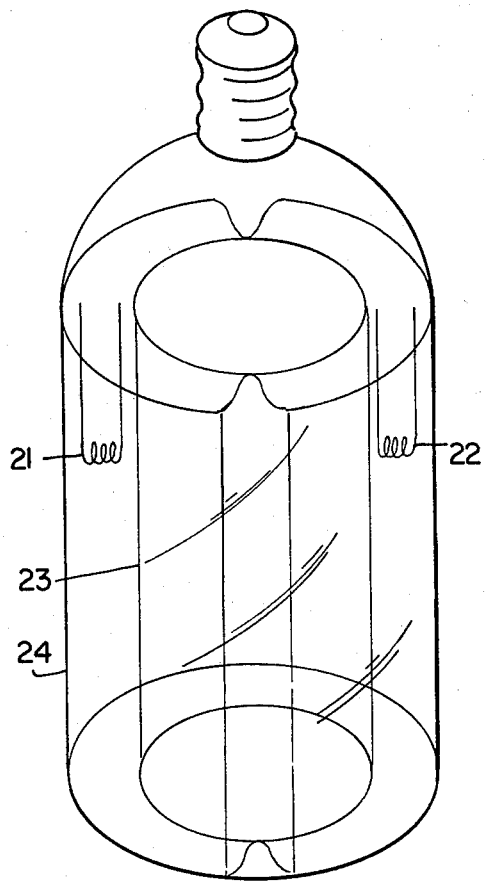

Another version rendered feasible by the inclusion of arc spreading initiators in the filling gas is shown in FIG. 3, a shape which conforms somewhat to that of incandescent lamps. The arc is established between filaments 21, 22 and lies between the inner and outer walls 23, 24 of the lamp.

What is claimed is:

1. An arc discharge device such as a fluorescent lamp comprising an envelope having an inner phosphor coating, arc discharge means in said envelope, a rare gas in said envelope and an arc spreading initiator gas in said envelope for spreading the arc, said rare gas being argon at a pressure of from 1–3 torr together with sufficient mercury to establish a vapor pressure of about 10 microtorr, said arc spreading initiator gas being a combination of nitrogen at a range of 0.1 to 0.2 microtorr and dichloro-difluoro ethane at about 0.25 microtorr.

2. An arc discharge device as set forth in claim 1 wherein said envelope is of non-circular cross section.

3. An arc discharge device as set forth in claim 1, wherein said arc spreading initiator causes the arc to assume alternate paths at a high rate of change.

4. An arc discharge device as in claim 3, wherein said arc spreading initiator is present in a range of concentration to create a rapidly varying, twisting, swirling arc, which in effect spreads the arc throughout said envelope.

5. An arc discharge device as set forth in claim 1 wherein said envelope is of non-circular cross section of such dimensions that were the arc stationary, only a fraction of the phosphor surface would be illuminated, yet where the arc is spread, the entire phosphor surface is illuminated.

6. An arc discharge device as in claim 1 wherein said arc path is compact and said lamp is fitted with a ballast and a screw base to mate with an Edison incandescent lamp socket and wherein said arc is spread throughout the volume of said lamp by said arc spreading initiator.

* * * * *